United States Patent [19]

Schäfer

[11] Patent Number: 4,561,705

[45] Date of Patent: Dec. 31, 1985

[54] COMPARTMENTED TRANSPORT AND STORAGE CONTAINER

[75] Inventor: Gerhard Schäfer, Neunkirchen-Salchendorf, Fed. Rep. of Germany

[73] Assignee: Fritz Schafer Gesellschaft mit beschrankter Haftung, Neunkirchen, Fed. Rep. of Germany

[21] Appl. No.: 486,364

[22] Filed: Apr. 19, 1983

[30] Foreign Application Priority Data

Apr. 19, 1982 [DE] Fed. Rep. of Germany ... 8211051[U]

[51] Int. Cl.[4] ..... B65D 6/00

[52] U.S. Cl. ..... 312/244; 220/4 E; 312/118; 312/199; 312/245

[58] Field of Search ..... 312/311, 199, 244, 245, 312/45, 72, 312, 118, 333; 220/4 B, 4 E

[56] References Cited

U.S. PATENT DOCUMENTS

| | | | |
|---|---|---|---|
| 386,681 | 7/1888 | Barnes | 312/311 |
| 1,565,889 | 12/1925 | Baker | 312/118 |
| 2,234,424 | 3/1941 | Alley | 312/45 |
| 2,443,871 | 6/1948 | Shield | 312/312 X |
| 2,555,332 | 6/1951 | Grahn | 312/244 X |
| 3,269,788 | 8/1966 | Kneer | 312/244 X |
| 3,295,713 | 1/1967 | Optner | 220/4 E |
| 3,310,905 | 3/1967 | Davis et al. | 220/4 B X |
| 3,481,066 | 12/1969 | Woolworth | 312/244 X |
| 3,603,272 | 9/1971 | Ditges | 108/901 X |
| 3,680,939 | 8/1972 | Peets | 312/244 X |
| 3,741,618 | 6/1973 | Newman | 312/244 X |
| 3,796,474 | 3/1974 | Noneman et al. | 312/333 |
| 4,034,926 | 7/1977 | Wegner | 220/4 E X |
| 4,084,865 | 4/1978 | Joyce | 312/111 |
| 4,294,498 | 10/1981 | Van Luit | 312/245 |
| 4,324,446 | 4/1982 | LeSage | 312/245 |

FOREIGN PATENT DOCUMENTS

| | | | |
|---|---|---|---|
| 43540 | 1/1982 | European Pat. Off. | 312/311 |
| 579351 | 3/1924 | France | 312/245 |
| 1038169 | 6/1951 | France | 312/311 |
| 928448 | 6/1963 | United Kingdom | 220/4 E |

*Primary Examiner*—William E. Lyddane
*Assistant Examiner*—Thomas A. Rendos
*Attorney, Agent, or Firm*—Karl F. Ross; Herbert Dubno

[57] ABSTRACT

A storage and transport container comprises a pair of like housings each having a normally vertical back wall having upright and parallel side edges and horizontal top and bottom edges, a pair of generally parallel side walls extending horizontally in one direction from the side edges, and respective generally parallel top and bottom walls bridging the side walls and extending in one direction from the top and bottom edges. Thus the housing has a front side open in the one direction. At least one horizontally extending partition projects in the one direction from the back wall intermediate the top and bottom walls, bridges the side walls, and forms two housing compartments. The top, side, and bottom walls each have a rear edge attached to the respective edge of the back wall and a front edge spaced in the one direction therefrom. A loop formed generally at the front edge of the top wall and extending upwardly therefrom is generally centered between the side walls. A hinge has one part at the front edge of one of the walls of one of the housings and another part at the front edge of one of the corresponding walls of the other housing and is articulated between the parts such that the two housings can swing about an axis generally parallel to the front edges of their one walls between an open position both open generally away from each other and a closed position open toward each other and with their side, top, and bottom walls aligned with each other and the loops adjacent and forming a handgrip.

13 Claims, 5 Drawing Figures

COMPARTMENTED TRANSPORT AND STORAGE CONTAINER

FIELD OF THE INVENTION

The present invention relates to a compartmented transport and storage container. More particularly this invention concerns such a container which can hold a plurality of different and segregated items for convenient transport and/or storage and/or display.

BACKGROUND OF THE INVENTION

A salesman, repairman, technician, or the like often has to carry a stock of parts or supplies that must be readily accessible on the job. Similarly it is known to provide freestanding racks for medical supplies or parts that are shipped in a container in which they are displayed and/or stored by the end user.

A standard such container is basically just a set of shelves with closed side, top, bottom, and back walls and with at least one horizontal partition forming a pair of compartments. A cover is releasably secured over the open front side of such a container to hold in the items in the compartments, and to secure bins or drawers that may be in the compartments.

A standard problem with such containers is that the contents do not remain segregated in their respective compartments during shipment. Jarring or suddenly displacing such a container will cause its contents to mix with each other, require sorting-out at the user's end.

Another drawback is that such containers do not hold very much, and in too few compartments. It is frequently desired, as for instance by an electrical repairman to stock a very large quantity of different small parts. To do so necessitates the use of several prior-art compartmented containers.

OBJECTS OF THE INVENTION

It is therefore an object of the present invention to provide an improved compartmented storage and transport container.

Another object is the provision of such a compartmented storage and transport container which overcomes the above-given disadvantages, that is which can carry a large volume of articles in a great many different compartments, while at the same time maintaining the articles wholly separate.

SUMMARY OF THE INVENTION

These objects are attained according to the instant invention in a storage and transport container comprising a pair of like housings each having a normally vertical back wall having upright and parallel side edges and horizontal top and bottom edges, a pair of generally parallel side walls extending horizontally in one direction from the side edges, and respective generally parallel top and bottom walls bridging the side walls and extending in one direction from the top and bottom edges. Thus the housing has a front side open in the one direction. At least one horizontally extending partition projects in the one direction from the back wall intermediate the top and bottom walls, bridges the side walls, and forms two housing compartments. The top, side, and bottom walls each have a rear edge attached to the respective edge of the back wall and a front edge spaced in the one direction therefrom. A loop formed generally at the front edge of the top wall and extending upwardly therefrom is generally centered between the side walls. A hinge has one part at the front edge of one of the walls of one of the housings and another part at the front edge of one of the corresponding walls of the other housing and is articulated between the parts such that the two housings can swing about an axis generally parallel to the front edges of their one walls between an open position both open generally away from each other and a closed position open toward each other and with their side, top, and bottom walls aligned with each other and the loops adjacent and forming a handgrip.

With this construction it is therefore possible to double the number of storage compartments, albeit with a corresponding reduction in individual compartment volume. Thus the arrangement can have twice as many small drawers, for instance, as a prior-art system allowing a great many different items to be transported, stored, and displayed. When the hinge is arranged at one of the sides, that is with the hinge axis vertical, the unit can be opened up with its two halves at about a right angle to each other and can stand stably in this position. The hand engaged around the two-part grip automatically holds the container closed during transport to prevent the contents from falling out, although something can be provided to secure together the two edges opposite the hinge edges. The two housings can be differently subdivided, with the one having drawers and/or horizontally elongated compartments and the other having pigeonholes and/or vertically elongated compartments.

Normally according to this invention the two housings are identical. Each has a plurality of such partitions forming a plurality of such vertically superposed compartments. To hold items or drawers in the compartments, the partition has a front edge formed with at least one upwardly projecting lip, or with a plurality of such upwardly projecting lips, one at the front of each compartment. In addition the top wall and partition each have an underside formed with at least one guide ridge extending in the one direction parallel to the side walls. Thus the compartments underneath the partition and top wall are each subdivided at the ridge into two subcompartments. A drawer bin fits generally complementarily in each of the subcompartments. The lips project down into the bins and act as stops for same.

The bins of this arrangement may also each have a partially open front side. The housings each further comprise a pivotal flap normally overlying the open front sides of the bins and pivotal up off same. This flap can be transparent to allow one to see the contents of each drawer while effectively segregating them from each other.

The side and back walls according to this invention have upper regions extending upward beyond the respective top walls. These upper regions form on the top walls an upwardly open vessel around the loops. This vessel is extremely convenient for the storage of frequently used tools or the like that should be available without having to swing open the container. The loops are vertically shorter than the upper region so that the grip is recessed in the vessel. This makes it possible to stack something on top of the container when it is closed.

The housings in accordance with this invention are each unitarily formed of one piece of a synthetic resin. To this end the partition is double-walled and forms a horizontal groove opening at the rear wall. More specifically the partition has an upper portion perpendicular to the rear wall and a lower portion forming the respective groove and forming an acute angle with the rear wall. When the partition has a front edge formed with a plurality of upwardly projecting lips, the rear wall is formed in line with each such lip with a throughgoing aperture. A mold part or extension engages through these apertures to form the tongues in an arrangement making it possible to form the housings in standard molds. The use of the same wall thickness throughout eliminates internal stresses, and the grooved structure at the partitions imparts great rigidity to the structure.

To further rigidify the container of this invention the side walls are formed with horizontally projecting annular rims. In addition each rim has a top-wall portion formed with an upwardly projecting tab and a bottom-wall portion formed with a complementary downwardly open recess. Thus the containers can be stacked atop each other with the tabs of the underlying containers engaging in the recesses of the overlying containers. In addition the rear wall is formed with at least one throughgoing hanging eye.

DESCRIPTION OF THE DRAWING

The above and other features and advantages will become more readily apparent from the following, reference being made to the accompanying drawing in which.

SPECIFIC DESCRIPTION

Figure 1:
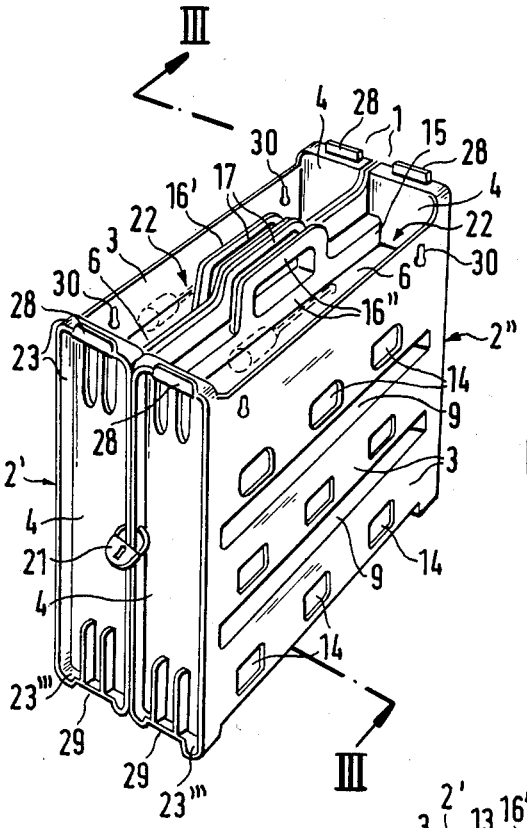
FIG. 1 is a perspective view of the container according to this invention when closed.
Figure 2:
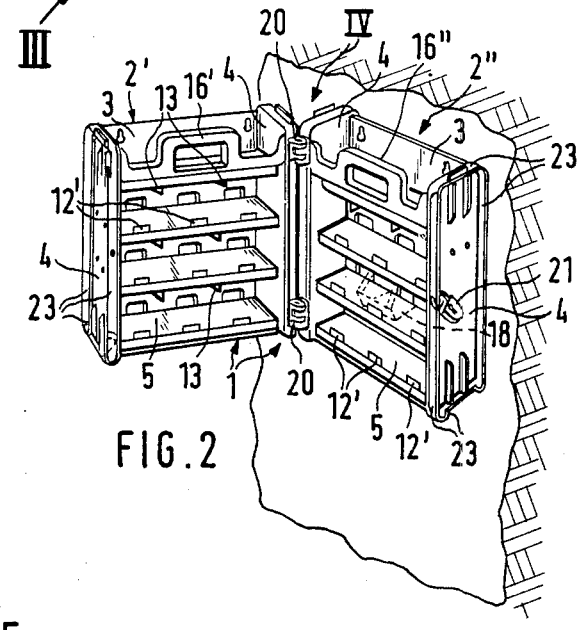
FIG. 2 is a small-scale perspective view illustrating the instant invention when open.
Figure 3:
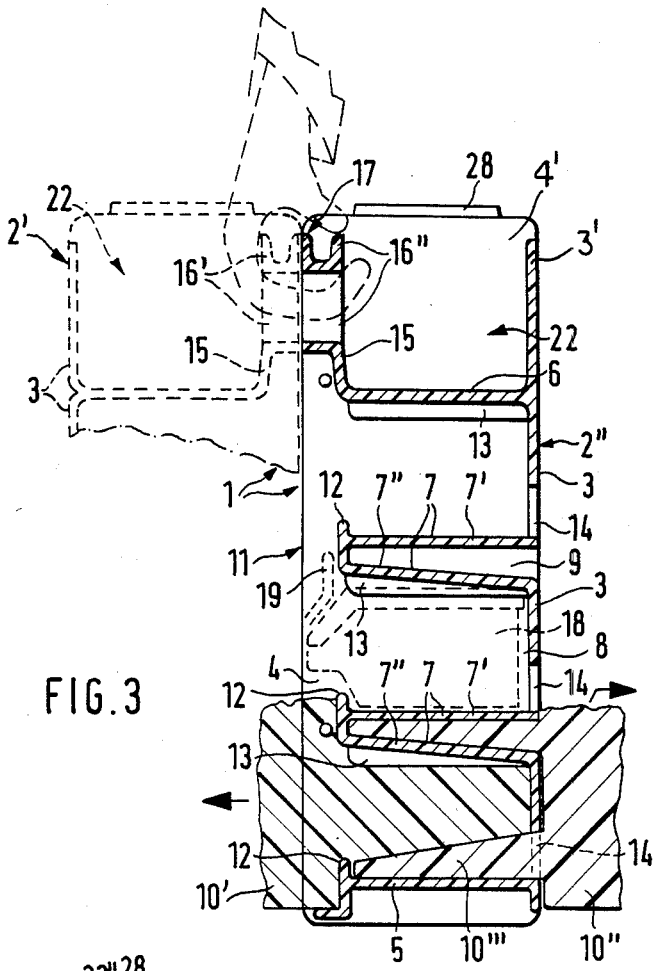
FIG. 3 is a section taken along the plane indicated at III—III of FIG. 1.
Figure 4:
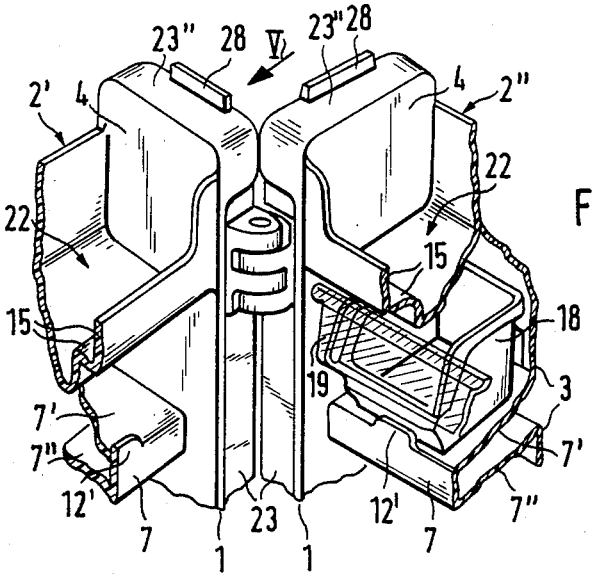
FIG. 4 is a large-scale view of the detail indicated by arrow IV in FIG. 2.

As seen in FIGS. 1–3 a container 1 according to this invention has a pair of identical halves or housings 2' and 2'' each made integrally by injection molding of synthetic resin, polyurethane or polyethylene being suitable.

Each housing 2' and 2'' has a normally vertical back wall 3, a pair of vertical side walls 4, a bottom wall or floor 5, a top wall 6, and partitions 7. The interior of the laterally open space formed by the walls 3, 4, and 5 has an open side 11 and is subdivided by the partitions or shelves 7 into compartments 8. These partitions 7 are each double-walled, having an upper web 7' extending perpendicular to the back wall 3 and a lower web 7'' extending at an obtuse angle thereto to form rearwardly open grooves 9 that open at the back 3. Such construction makes each housing 2' and 2'' dimensionally very stable, that is very stiff.

The front edge that is adjacent the open side 11 of each partition 7 and of the bottom wall 5 is formed with a single transversely throughgoing rib or with a plurality of upwardly projecting lips or tabs 12. In addition the underside of each partition 7 and of the top wall 6 is formed with a plurality of forwardly extending and downwardly projecting guide ridges 13 equispaced between the tongues or tabs 12 to subdivide the compartments 8 into smaller subcompartments each adapted to receive a respective bin or drawer 18.

As mentioned above the housings 2' and 2'' are injection molded. This is done by means of a multipart mold 10', 10'' illustrated in FIG. 3. The part 10'' has projections 10''' that fit into and form the grooves 9 and the back faces of the tongues 12. The mold part 10'' therefore forms apertures 14 in the back of each subcompartment behind each tab 12, which apertures 14 make freeing drawers 18 relatively easy if they become stuck.

The top walls 6 of the housings 2' and 2'' are formed at their front edges at the respective open side 11 with integral loops 16' and 16'' together forming, when the two housings 2' and 2'' are closed together as indicated in FIG. 1 with their open sides 11 coplanar, a central handgrip 17. The extreme upper portions 3' and 4' of the back and side walls 3 and 4 project up above the top wall 6 and in fact up above the grip 17 and similarly the front edge of each top wall 6 is raised at 15 to each side of the respective loops 16' and 16''. Thus they form an upwardly open vessel 22 when the arrangement is closed as indicated in FIGS. 1 and 3. Tools to which constant and ready access is needed can be stored in this space 22.

The side walls 4 are formed with annular rims 23 having upright side portions 23' and horizontal top and bottom portions 23'' and 23'''. These rims 23 reinforce the sides 4 and make them stiff, imparting great rigidity to the container 1. The upper portions 23'' are formed with upwardly projecting tabs 28 and the lower portions with complementary recesses 29. Thus one such container 1, open or closed, can be fitted atop another such container 1 and the upper one will not slip horizontally relative to the bottom one.

Figure 5:
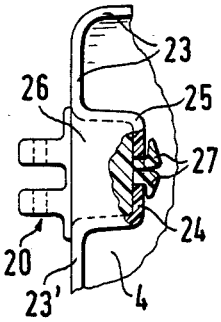
FIG. 5 is a partly sectional view taken in the direction of arrow V of FIG. 4.

As shown in detail in FIG. 5, the housings 2' and 2'' are hinged together at a hinge indicated generally at 20 and comprising two complementary hinge parts 26 fitted through the rim portions 23' and received in pockets 25 therebehind. Automatically spreading barbs 27 lock the hinge parts 26 in floor 24 of the pockets 25. This therefore makes a sturdy assembly of each container 1, capable of standing very stably, or of being opened up and hung on a wall. Several containers 1 with their tabs 28 and recesses 20 interfitting will open and close together making it possible to gain access to a supply of medical necessities rapidly. Normally the two housings 2' and 2'' are not moved beyond 90° to each other in the open position, but could be arranged to lie flat on a surface. To this end keyhole-shaped holes 30 are formed in the upper portion 3' of the rear walls 3 to allow such hanging-up of the opened or closed container 1. In addition the rims or flanges 23' opposite the hinge 20 can be clipped together by a padlock 21 or the like, although just holding the two loops 16' and 16'' is sufficient to keep the container 1 closed.

Pivotal covers 19 which are normally also transparent cover the open upper front sides of the bins 18 if necessary. These drawers or bins 18 fit snugly in the arrangement with their front ends lying just at the open front side. Thus when closed the bins 18 are solidly held in the container. When open they can be pulled out, to which end they are lifted a little. The tongues 12 catch under the rear walls of the bins 18 to prevent them from being pulled all the way out of the respective housing 2' or 2''.

With the system according to this invention it is therefore possible, for instance, for a repair technician to carry a large quantity of neatly ordered small parts and tools to a job. Frequently used tools are held in the top part 22 of the container 1 so they can be used without even opening it up. It is also possible to fill the various compartments with medical supplies and to sell it to an end user who need merely hang it on the wall for it to be ready for use.

What is claimed is:

1. A storage and transport container comprising:

a pair of identical housings each unitarily formed of a synthetic resin with a normally vertical back wall having upright and parallel side edges and horizontal top and bottom edges, a pair of generally parallel side walls extending horizontally in one direction from the side edges, respective generally parallel top and bottom walls bridging the side walls and extending in the one direction from the top and bottom edges, whereby the housing has a front side open in the one direction, the side and back walls having upper regions extending upward beyond the respective top walls, respective annular rims projecting horizontally oppositely from the side walls;

at least one horizontally extending partition projecting in the one direction from the back wall intermediate the top and bottom walls, bridging the side walls, and forming two housing compartments, the top, side, and bottom walls each having a rear edge attached to the respective edge of the back wall and a front edge spaced in the one direction therefrom and lying generally in a plane parallel to the respective back wall, and a loop formed generally at the front edge of the top wall, extending upward therefrom, and generally centered between the side walls, the loop being vertically shorter than the respective upper regions, the top wall being raised at the respective front edge to each side of the loop; and a hinge having one part at the respective rim at the front edge of one of the side walls of one of the housings and another part at respective rim at the front edge of the corresponding one of the side walls of the other housing and being articulated between the parts such that the two housings can swing about an axis generally parallel to the front edges of their one side walls between an open position both open generally away from each other and a closed position open toward each other, forming with the upper portions of the walls, the raised front edge of the top wall, and the loops respective upwardly open vessels, and the housings further having in the closed position their side, top, and bottom walls aligned with each other and the loops adjacent and forming a handgrip that is recessed between the vessels.

2. The storage and transport container defined in claim 1 wherein each housing has a plurality of such partitions forming a plurality of such vertically superposed compartments.

3. The storage and transport container defined in claim 1 wherein the partition has a front edge formed with at least one upwardly projecting lip.

4. The storage and transport container defined in claim 3 wherein the partition front edge is formed with a plurality of such upwardly projecting lips.

5. The storage and transport container defined in claim 3 wherein the partition has an underside formed with at least one guide ridge extending in the one direction parallel to the side walls, whereby the compartment underneath the partition is subdivided at the ridge into two subcompartments.

6. The storage and transport container defined in claim 5 wherein the partition front edge is formed with one such upwardly projecting lip in each subcompartment.

7. The storage and transport container defined in claim 6, further comprising a drawer bin fitting generally complementarily in each of the subcompartments.

8. The storage and transport container defined in claim 7 wherein each bin has a partially open front side, the housings each further comprising a pivotal flap normally overlying the open front sides of the bins and pivotal up off same.

9. The storage and transport container defined in claim 1 wherein the partition is double-walled and forms a horizontal groove opening at the rear wall.

10. The storage and transport container defined in claim 9 wherein the partition has an upper portion perpendicular to the rear wall and a lower portion forming the respective groove and forming an acute angle with the rear wall.

11. The storage and transport container defined in claim 9 wherein the partition has a front edge formed with a plurality of upwardly projecting lips, the rear wall being formed in line with each such lip with a throughgoing aperture.

12. The storage and transport container defined in claim 1 wherein each rim has a top-wall portion formed with an upwardly projecting tab and a bottom-wall portion formed with a complementary downwardly open recess, whereby the containers can be stacked atop each other with the tabs of the underlying containers engaging in the recesses of the overlying containers.

13. The storage and transport container defined in claim 1 wherein the rear wall is formed with at least one throughgoing hanging eye.

* * * * *